US005697488A

United States Patent [19]

Kaluza

[11] Patent Number: 5,697,488

[45] Date of Patent: Dec. 16, 1997

[54] APPARATUS FOR TRANSPORTING ROD-SHAPED ARTICLES

[75] Inventor: Manfred Kaluza, Hamburg, Germany

[73] Assignee: Hauni Maschinenbau AG, Hamburg, Germany

[21] Appl. No.: 271,014

[22] Filed: Jul. 6, 1994

[30] Foreign Application Priority Data

Jul. 24, 1993 [DE] Germany ..... 43 24 896.9

[51] Int. Cl.[6] ..... B65G 43/00

[52] U.S. Cl. ..... 198/464.2; 198/464.4; 198/481.1; 406/11; 406/68

[58] Field of Search ..... 198/464.2–464.4, 198/481.1, 493, 524, 526, 531; 131/282, 283, 909, 910; 406/11, 19, 31, 33, 63, 67, 68, 72

[56] References Cited

U.S. PATENT DOCUMENTS 3,614,166 10/1971 Spitz ..... 406/11
3,827,757 8/1974 Heitmann et al. .
4,368,742 1/1983 Wahle et al. ..... 131/282
4,429,781 2/1984 Holzhauser ..... 198/577
4,710,966 12/1987 Kägler ..... 406/29

FOREIGN PATENT DOCUMENTS 1127416 9/1968 United Kingdom .

*Primary Examiner*—Joseph E. Valenza
*Attorney, Agent, or Firm*—Darby & Darby

[57] ABSTRACT

An apparatus for transporting filter rod sections between the outlet of a magazine and the inlet of a pneumatic conveyor has a rotary drum with axially parallel peripheral flutes for the transfer of filter rod sections from the magazine into alignment with the inlet of the pneumatic conveyor. A pneumatic ejector is used to propel filter rod sections from successive flutes into the inlet of the pneumatic conveyor. The drum is discontinuously driven by an electric motor which accelerates the drum subsequent to each ejection of a filter rod section into the inlet of the pneumatic conveyor and at least decelerates the drum prior to movement of a flute into register with the inlet of the pneumatic conveyor and/or during ejection of filter rod sections from successive flutes.

14 Claims, 1 Drawing Sheet

APPARATUS FOR TRANSPORTING ROD-SHAPED ARTICLES

BACKGROUND OF THE INVENTION

The invention relates to improvements in apparatus for transporting rod-shaped articles, such as plain or filter cigarettes, cigars or cigarillos, filter rod sections and/or other rod-shaped articles of the tobacco processing industry. More particularly, the invention relates to improvements in apparatus which can be utilized with advantage for the transfer of filter rod sections or analogous rod-shaped articles from the outlet of a magazine for such articles to the inlet of a pneumatic conveyor wherein the articles are propelled seriatim in the direction of their axes to a processing station, e.g., into the magazine of a filter tipping machine for cigarettes or other tobacco-containing commodities. Still more particularly, the invention relates to improvements in apparatus wherein the means for transferring articles from the outlet of the magazine to the inlet of the pneumatic conveyor comprises a rotary conveyor and the means for transferring articles from the rotary conveyor into the inlet of the pneumatic conveyor comprises a pneumatic transfer system.

Apparatus of the above outlined character are disclosed in commonly owned U.S. Pat. No. 3,827,757 granted Aug. 6, 1974 to Bob Heitmann et al. for "Apparatus for transporting rod-shaped articles". Such apparatus are utilized all over the world in machines known as FILTROMAT which are distributed by the assignee of the present application. The machines known as FILTROMAT are employed to pneumatically transport filter rod sections from makers of such sections to one or more processing or consuming machines, such as filter tipping machines for filter cigarettes.

The apparatus which is disclosed in the patent to Heitmann et al. utilizes a rotary drum-shaped conveyor having a set of equidistant peripheral flutes which are parallel with the axis of the rotary conveyor and each of which can receive a filter rod section from the outlet of a magazine while the rotary conveyor is driven at a constant speed. The outlet of the magazine is dimensioned in such a way that it can simultaneously deliver filter rod sections to two or more peripheral flutes which are located at or close to the twelve o'clock position if the fluted conveyor is rotated about a horizontal axis. The flutes which carry filter rod sections advance toward the six o'clock position of the rotary conveyor into temporary alignment with the inlet of the pneumatic conveyor. A pneumatically operated ejector system is provided to expel filter rod sections from successive flutes while such flutes register with the inlet of the pneumatic conveyor. The pneumatic conveyor delivers successive filter rod sections (the length of which is normally several times unit length) into a the magazine of a filter tipping machine. Each filter rod section which leaves the magazine of the filter tipping machine is severed to yield two or more shorter filter rod sections, and the thus obtained shorter filter rod sections are united with plain cigarettes of unit length to form filter cigarettes of unit length or multiple unit length. The means for uniting includes so-called tipping paper which is draped around the locus of abutment of one end portion of a short filter rod section with one end portion of a plain cigarette. Alternatively, each end portion of a filter rod section of double unit length is united with a discrete plain cigarette of unit length to form a filter cigarette of double unit length which is thereupon severed midway across the filter rod section to yield two filter cigarettes or unit length.

A moodern filter tipping machine can turn out up to 14,000 filter cigarettes per minute. This means that the apparatus which feeds filter rod sections into the inlet of the pneumatic conveyor serving to continuously replenish the supply of filter rod sections in the magazine of the filter tipping machine must deliver successive filter rod sections at a very high rate, i.e., the intervals between expulsion of filter rod sections from successive flutes of the rotary conveyor are extremely short. In other words, the aforementioned pneumatic ejector system must be designed to furnish successive jets of compressed air or another fluid at extremely short intervals which, in turn, is likely to cause more or less frequent stoppages of the apparatus in order to permit removal of a damaged or destroyed filter rod section which failed to fully enter the inlet of the pneumatic conveyor from the corresponding flute of the continuously driven rotary conveyor. In view of the extremely high output of a modern filter tipping machine, even a very short stoppage of the rotary conveyor between the magazine for filter rod sections and the inlet of the pneumatic conveyor can entail enormous losses in output. The apparatus of Heitmann et al. is particularly likely to shear off or wedge the trailing end of a filter rod section between the inlet of the pneumatic conveyor and the adjacent flute of the rotary conveyor. Stoppages of the apparatus of Heitmann et al. normally necessitate stoppages of the filter tipping machine which receives filter rod sections from the pneumatic conveyor as well as of the machine or machines (e.g., packing machines) which receive filter cigarettes from the filter tipping machine. All this compounds the losses in output of a production line which includes one or more cigarette makers, one or more filter rod making machines, one or more filter tipping machines, one or more reservoirs for plain or filter cigarettes and/or filter rod sections and one or more packing machines.

OBJECTS OF THE INVENTION

An object of the invention is to provide a novel and improved apparatus for the transport of rod-shaped articles which constitutes an improvement over and a further development of apparatus disclosed in the patent to Heitmann et al.

Another object of the invention is to provide an apparatus which is less likely to damage rod-shaped articles between the rotary conveyor and the pneumatic conveyor than heretofore known apparatus.

A further object of the invention is to provide the apparatus with novel and improved means for driving the rotary conveyor.

An additional object of the invention is to provide an apparatus which can transfer rod-shaped articles between a magazine and a pneumatic conveyor at a rate which is higher than the rate of transfer of rod-shaped articles in heretofore known apparatus.

Still another object of the invention is to provide an apparatus which is less likely to cause prolonged stoppages of the machine or machines which are to receive rod-shaped articles from the apparatus.

A further object of the invention is to provide an apparatus which can reliably transfer rod-shaped articles from a rotary conveyor into or onto a pneumatic conveyor without any damage to the conveyed articles and which can enable a production line to turn out larger numbers of rod-shaped articles per unit of time.

Another object of the invention is to provide a novel and improved machine or production line which employs the above outlined apparatus.

An additional object of the invention is to provide a novel and improved apparatus for the transport of filter rod sections to a filter tipping machine.

SUMMARY OF THE INVENTION

The invention is embodied in an apparatus for transporting rod-shaped articles of the tobacco processing industry (such as filter rod sections) from a supply of preferably parallel articles in a magazine into an inlet of a pneumatic conveyor. The apparatus comprises a rotary conveyor (e.g., a drum which is rotatable about a predetermined axis) having a series of receptacles for rod-shaped articles (e.g., in the form of flutes machined into or otherwise formed in the peripheral surface of the drum and being parallel with the axis of the drum) and being disposed between an outlet of the magazine and the inlet of the pneumatic conveyor, means for discontinuously driving the rotary conveyor to a plurality of different angular positions in each of which one of the series of receptacles is aligned with the inlet and at least one other receptacle registers with and can receive articles from the outlet of the magazine, and means for pneumatically transferring articles from the one receptacle into the inlet of the pneumatic conveyor.

The receptacles of the rotary conveyor preferably form a circular array of equidistant receptacles, and the driving means can comprise means for indexing the rotary conveyor to align successive equidistant receptacles of the array with the inlet of the pneumatic conveyor. The indexing means can comprise means for alternately rotating the rotary conveyor at a higher first speed to move successive equidistant receptacles toward alignment with the inlet of the pneumatic conveyor, and at a lower second speed (e.g., zero speed or close to zero speed) during intervals between movements of the rotary conveyor at the first speed.

In accordance with a presently preferred embodiment of the invention, the indexing means comprises a variable-speed prime mover and means for varying the speed of the prime mover in accordance with a predetermined program. The prime mover can include or constitute a variable-speed electric motor. The means for varying the speed of the prime mover can comprise a source of first signals denoting a desired first speed of the prime mover, means for generating second signals denoting the actual speed of the prime mover, means for generating third signals denoting the difference (if any) between the first and second signals, an energy source for the prime mover, and adjustable amplifier means interposed between the energy source and the prime mover to regulate the transmission of energy to the prime mover as a function of the intensity and/or other characteristics of the third signals.

The source of first signals and/or the means for generating second signals can include means for transmitting incremental signals. Alternatively, the source of first signals and/or the means for generating second signals can include means for generating and/or transmitting coded digital signals.

The apparatus can further comprise means for monitoring the transfer of articles from the one receptacle (namely the receptacle which is aligned with the inlet of the pneumatic conveyor) into the inlet of the pneumatic conveyor and for arresting the driving means in response to detection of unsatisfactory transfer of articles into the inlet of the pneumatic conveyor.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawings.

DESCRIPTION OF PREFERRED EMBODIMENTS

Figure 1:
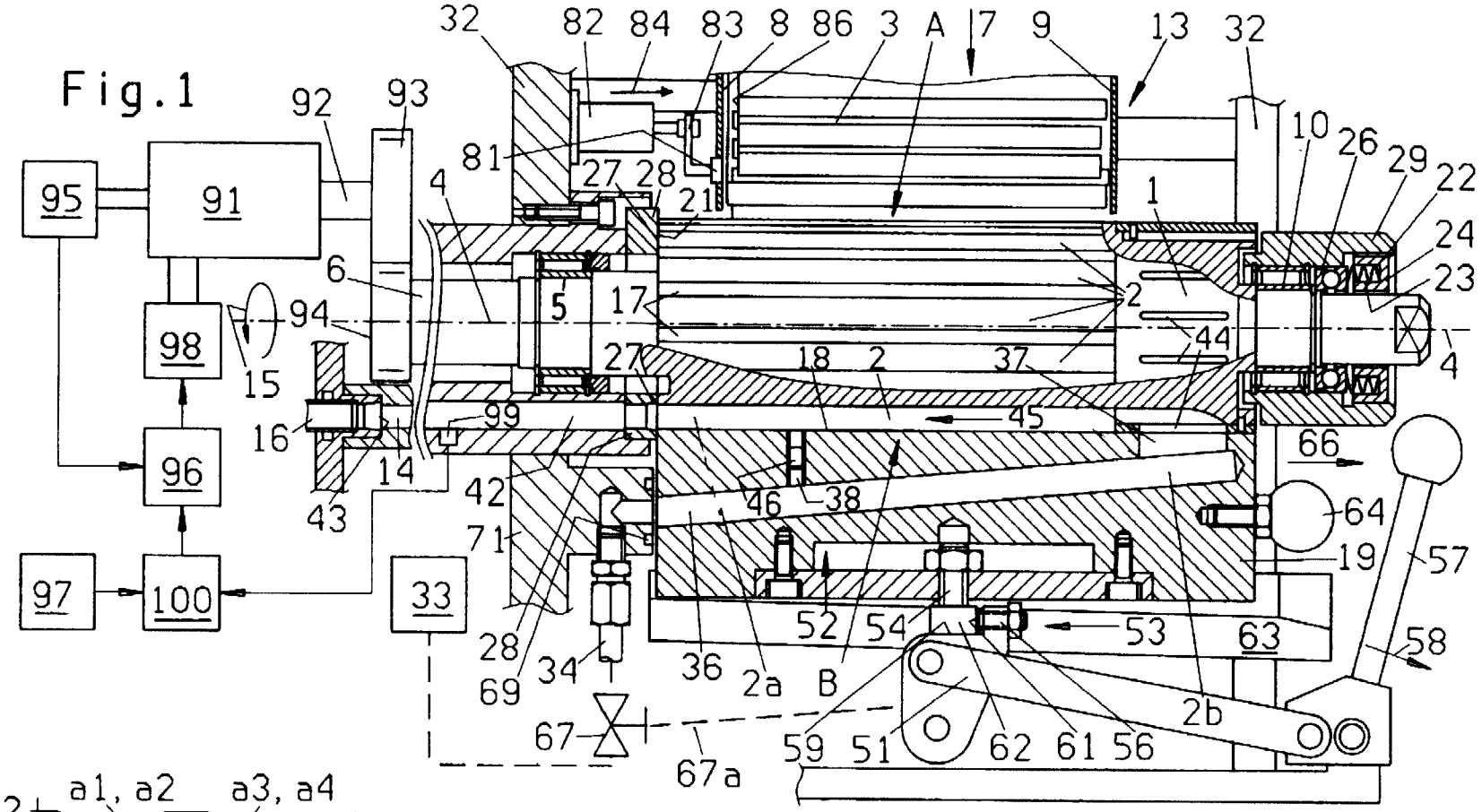
FIG. 1 is a schematic partly elevational and partly vertical sectional view of an apparatus which embodies one form of the invention.

The apparatus which is shown in FIG. 1 is designed to transfer rod-shaped articles 3 (such as filter rod sections which are to be united with plain cigarettes to form filter cigarettes of unit length or multiple unit length) from the outlet at the bottom end of a magazine 13 into the inlet 43 of a pneumatic conveyor 16. The outlet of the magazine 13 is located at a first station A and the inlet 43 of the pneumatic conveyor 16 is located at a station B at a level beneath the station A. The conveyor 16 advances a file of successive articles 3 into the magazine of a processing machine, such as a filter tipping machine, or into another magazine, not shown. The pneumatic conveyor 16 includes an elongated tube or hose which can advance the articles along a straight or along an arcuate or other non-linear path in a manner not forming part of the present invention.

The improved apparatus comprises a rotary conveyor 1 in the form of a drum having a peripheral surface provided with a plurality of equidistant receptacles 2 in the form of flutes. Each flute 2 is open in a direction away from the axis of the drum 1 so that it can receive an article 3 during movement along or during a period of dwell beneath the outlet of the magazine 13 at the station A. The outlet of the magazine 13 is preferably dimensioned in such a way that it can simultaneously communicate with and deliver articles 3 to two or more flutes 2 at the station A. Reference may be had to FIG. 3 of the patent to Heitmann et al. which shows that the outlet of the magazine can simultaneously communicate with at least three flutes of the rotary conveyor. The flutes 2 of the drum 1 are parallel to the axis 4 of rotation of the drum 1. The axis 4 of the illustrated drum 1 is at least substantially parallel to the axes of articles 3 in the magazine 13 and to the flutes 2.

The shaft 6 of the drum 1 is journalled in radial antifriction bearings 5 and 10 and is mounted for rotation in the direction of arrow 15. The supply 7 of articles 3 in the magazine 13 is received from a filter rod making machine whose construction and/or mode of operation forms no part of the present invention. FIG. 1 merely shows two spaced apart parallel walls 8 and 9 which form part of the magazine 13 and are adjacent the respective ends of the articles 3 constituting the supply 7.

The apparatus further comprises a pneumatic ejector which operates at the station B to propel discrete articles 3 from successive flutes 2 of the drum 1. The ejector comprises a fixed conduit 14 which registers with the inlet 43 of the pneumatic conveyor 16 and has an internal diameter at least matching but preferably slightly exceeding the diameter of an article 3.

Each flute 2 of the drum 1 is flanked by two axially parallel ribs 17 whose radially outermost surfaces are convex and sealingly engage a concave complementary surface 18 on a block-shaped member 19 at the station B. The dimensions of the concave surface 18 are selected in such a way that it is engaged by the convex surface of an oncoming rib 17 during advancement of such rib toward the station B, during the interval of dwell at or during advancement past the station B as well as during the initial stage of movement beyond the station B. The block 19 is preferably made of a material (e.g., polyamide) having satisfactory or highly satisfactory self-lubricating or antifriction characteristics.

The left-hand end face 21 of the drum 1 is biased against the adjacent surface 27 of a sealing ring 28 which is mounted in a frame 32 of the apparatus. The means for biasing the end face 21 of the drum 1 against the surface 27 of the ring 28 comprises a set of coil springs 22 which are confined in the sockets 23 of a nut 24 having internal threads in mesh with the external threads of a sleeve 29. A thrust bearing 26 is installed between the springs 22 and the adjacent race or races of the radial bearing 10 to urge such race or races against the adjacent axial end of the drum 1. The sleeve 29 has two outwardly extending wings or analogous projections which are affixed to the frame 32 by threaded fasteners, e.g., in a manner as shown in FIG. 3 of the patent to Heitmann et al.

The block 19 is provided with a channel 36 which is connected to a source 33 of compressed gaseous fluid (e.g., air) by way of an ejector conduit 34 containing a shutoff valve 67. The conduit 34 communicates with spaced apart first and second ports 37 and 38 for a pressurized gas (hereinafter called air). The port 37 communicates with a flute 2 at the station B only when such flute is in accurate alignment with the passage 42 of the fixed conduit 14. The receiving (right-hand) end of the passage 42 in the conduit 14 is wider than the major part of such passage to thus facilitate the entry of the leader of an article 3 which is about to be ejected from the respective flute 2 of the drum 1. When a flute 2 reaches a position of accurate or adequate alignment with the passage 42 of the conduit 14, one of an annulus of equidistant elongated slots 44 in the drum 1 admits a blast of compressed air which propels the article 3 from the respective flute 2 and into the passage 42. The thus admitted blast of compressed air abruptly propels the article 3 at the station B in the direction of arrow 45. A slot 44 is provided in the drum 1 for each of the flutes 2, and successive slots 44 advance toward a position of communication with the port 37 and thereupon beyond the port 37 and back toward the station A in response to indexing of the drum 1 and of its flutes 2 about the axis 4.

The port 38 of the block 19 contains a flow restrictor 46 and is configurated in such a way that it begins to communicate with an oncoming flute 2 even before such flute reaches the position of accurate alignment with the conduit 14 at the station B. Furthermore, the port 38 continues to communicate with a flute 2 during the initial stage of advancement of such flute beyond the station B, i.e., beyond the angular position of accurate axial alignment with the passage 42 of the conduit 14.

The block 19 is urged against the convex radially outer surfaces of the adjacent ribs 17 of the drum 1 by a pivotable lever 51. Adjustable threaded fasteners 54 and 56 are provided to select the bias of the block 19 in directions which are indicated by arrows 52 and 53, respectively. When the arm 57 of the lever 51 is pivoted in the direction of arrow 58, two blocking surfaces 59 and 61 are disengaged from the head 62 of the fastener 54 so that the fastener 54 can be adjusted to select the bias of the concave surface 18 of the block 19 against the adjacent ribs 17. The surface 59 is provided on the lever 51 or on a member which is carried by the lever, and the surface 61 is the front end face of the fastener 56. The fastener 56 is adjustable to select the bias of the block 19 against the sealing ring 28. The entire block 19 can be partially or fully withdrawn from the frame 32 upon release of the fastener 54. A handgrip portion 64 is provided to facilitate the extraction of the block 19 in the direction of arrow 66 when the arm 57 of the lever 51 is moved out of the way. A support 63 serves as a rest for the block 19 when the surfaces 59 and 61 are disengaged from the head 62 of the fastener 54 so that the block can descend by gravity.

The just described mounting of the block 19 is desirable and advantageous because it ensures that a person in charge can gain access to the flutes 2 and the slots 44 at the station B, for example, to clean the slots and/or to remove a defective or damaged article 3 from its flute. Furthermore, the extracted block 19 can be readily inspected and its ports 37 and 38 cleaned and/or the flow restrictor 46 replaced if and when necessary.

A broken line **67*a* indicates in FIG. 1 a suitable linkage which receives motion from the lever 51 when the arm 57 is pivoted in the direction of the arrow 58 whereby the linkage 67*a* automatically shuts the valve 67 to prevent further flow of compressed air from the source 33 into the conduit 34 and thence into the channel 36 and the ports 37, 38 of the block 19. In other words, the lever 51 cooperates with the valve 67 to prevent the escape of compressed air from the source 33 when the block 19 is moved away from sealing engagement with the ribs 17 of the drum 1 and with the ring 28**.

FIG. 1 further shows a sealing element 69 (e.g., an O-ring) which is interposed between a fixed wall 71 and the adjacent face of the block 19.

The apparatus further comprises means for preventing the articles 3 in the lower portion of the magazine 13 from descending into the flutes 2 at the station A. Such preventing means comprises a composite or one-piece pressure pad 81 having a surface (the right-hand surface as viewed in FIG. 1) which is normally coplanar with the inner (right-hand) side of the wall 8 forming part of the magazine 13. The pad 81 can be made of an elastomeric material (such as rubber) and has an arcuate shape generally conforming to but being spaced apart from the adjacent portion of the fluted peripheral surface of the drum 1. The means for moving the pad 81 into and from engagement with the end faces of adjacent articles 3 comprises an electromagnet 82 and a bell crank lever 83 which can be moved in the direction of arrow 84 in order to move the pad in a direction to the right, as viewed in FIG. 1. The pad 81 extends across the entire outlet of the magazine 13, i.e., from the non-referenced rear wall to the non-illustrated front wall of the magazine.

Additional details of the apparatus which is shown in FIG. 1 are fully described and shown in the specification of the patent to Heitmann et al.; the disclosure of this patent is incorporated herein by reference.

The means for discontinuously driving the drum 1 comprises a variable-speed prime mover 91, e.g., an electric motor, having a rotary output element 92 for a driver gear 93. The latter mates with a driven gear 94 on the adjacent portion of the shaft 6 which is non-rotatably connected to the drum 1. The means for varying the speed of the motor 91 comprises a tachometer generator 95 or an analogous device which is designed to transmit singals denoting the actual speed of the motor 91. The signals at the output of the tachometer generator 95 are transmitted to one input of a signal comparing stage 96. Another input of the stage 96 is connected with the output of a source 97 of signals denoting the desired speed of the motor 91 in each of a number of different angular positions of the drum 1. The output of the stage 96 transmits signals to an amplifier 98 which is installed between an energy source (not specifically shown)

and the motor 91 to regulate the voltage and/or current at the input of the motor 91 in dependency upon the intensity and/or other characteristics of signals at the output of the signal comparing stage 96. The tachometer generator 95 and the source 97 are or can constitute sources of digital signals, i.e., the outputs of the generator 95 and source 97 can transmit incremental signals in the form of pulse sequences. However, it is also within the purview of the invention to employ sources of coded signals; this renders it possible to ascertain the absolute angular position of the output element 92 of the motor 91.

A motor which can be utilized in the means for discontinuously driving the drum 1 is distributed by the Firm Bautz, Robert-Bosch-Strasse 10, D-64331 Weiterstadt, Federal Republic Germany. A presently preferred motor which can be obtained from Bautz is an a-c servomotor of the type known as M 506 F. The amplifier 98 can be an operational amplifier known as Type MSK 06 or MSK 12, also distributed by Bautz. The motor can be utilized in combination with an encoder, e.g., type ES 1 (also distributed by Bautz), which can constitute or can replace the tachometer generator 95. The amplifier 98 comprises a suitable memory for signals a (FIG. 2) denoting the desired sequence of movements of the drum 1 in successive angular positions of the shaft 6.

The signal sources 95 and 97 can be omitted if the prime mover of the means for discontinuously driving the drum is a stepping motor which is capable of rapidly and reliably responding to a sequence of signals denoting the desired rotational speed of the shaft 6 in different angular positions of the drum 1.

FIG. 1 further shows a detector or sensor 99 which is adjacent the passage 42 in the conduit 14 and serves to monitor the transfer of articles 3 from the flutes 2 of the drum 1 into the pneumatic conveyor 16. The detector 99 transmits signals in response to detection of unsatisfactory transfer of articles 3 into the inlet 43 of the conveyor 16. Such signals can denote the absence of transfer or jamming of the passage 42 by a damaged or destroyed article 3. The detector 99 can comprise a radiation source which directs one or more beams of radiation against the adjacent article 3 or against the surface bounding the passage 42, and a transducer which responds to deflected radiation to generate signals denoting satisfactory or unsatisfactory transfer of articles.

The output of the detector 99 is connected with a gate circuit 100 which is installed in the signal transmitting connection between the output of the signal source 97 and the corresponding input of the signal comparing stage 96. The circuit 100 is designed to block the transmission of signals from the source 97 to the stage 96 in response to the generation of a "defect" signal by the detector 99. Thus, the prime mover 91 is arrested in response to a "defect" signal from the detector 99 to prevent further angular movements of the drum 1 until the cause of the generation of a "defect" signal is ascertained and eliminated. As a rule, a "defect" signal will be generated if a defective article 3 is stuck in the passage 42 of the conduit 14 so that the next-following article 3 cannot be transferred from its flute 2 into the inlet 43 of the pneumatic conveyor 16. The arrangement is preferably such that each signal from the detector 99 which is not indicative of an unsatisfactory transfer of an article 3 into the conveyor 16 is used to initiate the next cycle of operation of the motor 91 but that each "defect" signal from the detector 99 results in an interruption of signal transmission from the source 97 so that the drum 1 comes to a halt.

The mode of operation of the improved apparatus is as follows:

When the shaft 6 receives torque from the output element 92 of the motor 91 by way of the gear train 93, 94, it drives the drum 1 in the direction of arrow 15 so that successive flutes 2 enter the station A and receive articles 3 from the supply 7 in the magazine 13. The electromagnet 82 is deenergized so that the pad 81 is maintained in the illustrated retracted position and the articles 3 of the supply 7 are free to descend into the flutes 2 at or close to the twelve o'clock position of the endless path for the flutes 2 about the axis 4. The flutes 2 which carry articles 3 advance seriatim from the station A toward the station B to become aligned with the passage 42 of the fixed conduit 14 forming part of the pneumatic ejector.

Successive flutes 2 begin to communicate with the port 38 of the block 19 at least slightly prior to movement into exact alignment with the passage 42 of the conduit 14. This enables compressed air to enter the oncoming flutes at a rate which is determined by the flow restrictor 46 so that the pressure of compressed air in the portions **2*a* and 2*b* of the oncoming flute 2 is the same, i.e., the stream of compressed air which is admitted through the flow restrictor 46 can flow to both ends of the article 3 in the oncoming flute because the admitted compressed air can flow around the periphery of the article 3 advancing toward the position of exact axial alignment with the passage 42. At such time, the respective slot 44 of the drum 1 is on its way toward a position of communication with the port 37 of the block 19. This ensures that an article 3 in the flute which is about to move toward a position of exact axial alignment with the passage 42 (i.e., in which such flute receives a blast of compressed air from the port 37 and through the associated slot 44), is not moved axially in or counter to the direction of arrow 45 before the start of the actual expelling step. It is to be borne in mind that the pressure of air in the conveyor 16 is well above atmospheric pressure so that, in the absence of admission of compressed air via flow restrictor 46 prior to exact alignment of an oncoming flute 2 with the passage 42, the body of compressed air in the conduit 14 and the conveyor 16 would initiate abrupt advancement of the article in a direction counter to that indicated by the arrow 45**.

When an oncoming slot 44 of the drum 1 begins to comunicate with the port 37 of the block 19, the right-hand end face of the article 3 in the respective flute 2 is abruptly subjected to the action of compressed air in the channel 36 so that the article moves in the direction of the arrow 45 into and through the passage 42 of the conduit 14 and into and beyond the inlet 43 of the pneumatic conveyor 16. Entry of the leader of an article into the passage 42 of the conduit 14 is facilitated by enlarging the intake end of the passage, e.g., in such a way that the intake end is defined by a frustoconical surface which diverges in a direction counter to that indicated by the arrow 45. The port 38 continues to admit compressed air into the passage 42 subsequent to expulsion of an article from its flute 2 into the passage 42 so that the advancement of the freshly expelled article 3 in the passage 42 can continue in a direction to the left, as viewed in FIG. 1.

The aforedescribed sealing engagement of the concave surface 18 of the block 19 with the top lands of the ribs 17 on the drum 1, as well as the sealing engagement of the end face 21 of the drum with the sealing ring 28 suffices to prevent the escape of appreciable quantities of compressed air which is supplied by the source 33, even if the air is supplied at a high or very high pressure. This ensures that the pressure in the portion **2*a* of a flute 2 at the station B can rise practically instantaneously when the corresponding slot 44 begins to communicate with the port 37 of the block 19**.

Each slot 44 is preferably narrow (as seen in the circumferential direction of the drum 1) so that it begins to communicate with the slot 37 at the exact instant when the respective flute 2 is in accurate register with the passage 42 of the conduit 14. The thus obtained short-lasting pulses of compressed air suffice to ensure the expulsion of an article 3 from the flute 2 at the station B before the angular position of the drum is changed to an extent which would suffice to result in damage to or destruction of the article advancing toward the pneumatic conveyor 16.

The aforedescribed assembly of parts 91 to 100 constitutes a means for discontinuously driving the drum 1. The signals a which the source 97 transmits to the corresponding input of the signal comparing stage 96 as a function of time t are denoted by the substantially undulate curve in the diagram of FIG. 2. Such signals are compared (at 96) with those which are transmitted by the source 95 and denote the actual rotational speed of the drum 1. The resulting signals are transmitted to the amplifier 98 in order to alter the speed of the drum 1 if the characteristics of signals from the source 97 deviate from those transmitted by the source 95. This results in acceleration or deceleration of the output element 92.

If an article 3 is being expelled from its flute 2 at an instant t1 when the rotational speed of the drum 1 is relatively low, i.e., if such speed corresponds to the intensity or another characteristic of the signal a1 from the source 97, the detector 99 transmits to the gate circuit 100 a signal which indicates completion of a satisfactory transfer of the monitored article 3 into the pneumatic conveyor 16. The circuit 100 then opens the path for the transmission of a signal a1, a2 during the interval between the instants t1 and t2, i.e., the intensity of the signal from the source 97 increases which induces the signal comparing stage 96 to cause the amplifier 98 to effect an acceleration of the drum 1 during the interval of advancement of a freshly evacuated or emptied flute 2 from the station B and simultaneous advancement of the next-following filled flute 2 toward the angular position of alignment with the passage 42 of the conduit 14.

Acceleration of the motor 91 is terminated at the instant t2, i.e., the drum 1 is thereupon driven at a constant elevated speed corresponding to that of the intensity of signal a2 from the source 97 during the interval between the instants t2 and t3. In other words, the angular velocity of the drum 1 abruptly increases (between t1 and t2) upon successful completion of transfer of an article 3 from the respective flute 2 into the passage 42 of the conduit 14. The signal a3, a4 from the source 97 thereupon causes the signal comparing stage 96 and the amplifier 98 to abruptly decelerate the drum 1 back to the speed denoted by the signal a1; this takes place during the interval between the instants t3 and t4. Thus, the speed of the drum 1 is reduced to ensure satisfactory, predictable and reliable transfer of the next-following article 3 into the pneumatic conveyor 16 during the short interval (between t4 and t5) when the respective flute 2 is in accurate alignment with the passage 42 so that the respective slot 44 can receive a blast of compressed air from the source 33 via conduit 34, channel 36 and port 37. Satisfactory transfer of the article 3 from its flute 2 into the conveyor 16 is ascertained by the detector 99 which induces the gate circuit 100 to again establish a connection for the transmission of signals from the source 97 to the signal comparing stage. The aforedescribed sequence of abrupt acceleration of the drum 1 (between t5 and t6), followed by rotation at a constant elevated speed (between t6 and t7) and thereafter by abrupt deceleration (between t7 and t8) is thereupon repeated again and again as long as the signals from the detector 99 to the gate circuit 100 denote satisfactory transfer of articles 3 from their flutes 2 into the pneumatic conveyor 16.

Figure 2:
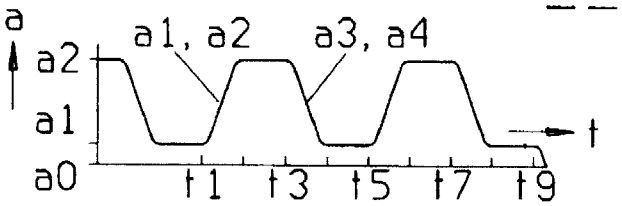
FIG. 2 is a diagram wherein the curve indicates signals denoting the desired variations of speed of the prime mover for the rotary conveyor.

The diagram of FIG. 2 shows a substantial difference between the intensities of signals 1*a* (minimum speed of the drum 1) and a2 (maximum speed of the drum). The difference can be even more pronounced (for example, the signal a1 can be indicative of zero speed or of a speed close to zero speed) or less pronounced. It is further possible to increase the intensity of signals a2 without changing the intensity of signals a1. Each stage of speed changes of the drum 1 involves abrupt acceleration (as between t1 and t2 or between t5 and t6 in FIG. 2), rotation at constant or nearly constant elevated speed (as between t2 and t3 or between t6 and t7), and thereupon rapid deceleration (between t3 and t4 or between t7 and t8).

As mentioned above, the minimum speed of the drum 1 (during actual transfer of an article 3 into the pneumatic conveyor 16) can be reduced all the way to zero. However, it has been found that a deceleration to zero speed is not always necessary or not absolutely necessary; it suffices to decelerate the drum immediately prior to actual expulsion of successive articles 3 from their respective flutes 2.

The angular velocity of the motor 91 (e.g., the aforementioned a-c servomotor M 506 F supplied by Bautz) can be readily changed in accordance with the intensities and/or other characteristics of signals which are furnished by the source 97.

If the detector 99 fails to transmit a signal denoting satisfactory completion of transfer of an article 3 into the conveyor 16 (e.g., during the interval between the instants t8 and t9 in the diagram of FIG. 2) upon completion of an angular movement at a reduced speed or zero speed (signal a1), this is indicative of a potential or actual defect, e.g., of jamming or destruction of an article 3 upstream of the inlet 42 of the pneumatic conveyor 16. The detector 99 then causes the gate circuit 100 to remain closed so that the transmission of signals from the source 97 to the signal comparing stage 96 is interrupted. Consequently, the speed of the motor 91 (and of the drum 1) is then reduced to zero as indicated by the signal a0 in the diagram of FIG. 2. The operator in charge is then free to gain access to the passage 42 of the conduit 14 and to the nearest flute 2 (upon removal of the block 19 in the aforedescribed manner) so that a jammed article 3 can be extracted prior to being subdivided at the end face 21 of the drum 1) or that a damaged (e.g., shredded or severed) article can be removed from the apparatus.

It has been found that the aforedescribed variations of the speed of the motor 91 and drum 1 ensure reliable and predictable transfer of successive articles 3 from their flutes 2 into the pneumatic coneveyor 16. The drum 1 is abruptly accelerated during advancement of a foremost filled (article containing) flute toward the station B, is thereupon driven at an elevated speed prior to abrupt deceleration while the foremost flute is abut to reach the position of accurate alignment with the passage 42 of the conduit 14, and is then driven at a reduced speed (which may but need not be zero speed) during actual transfer of articles into the conduit 14 and conveyor 16. Furthermore, the detector 99 ensures practically instantaneous stoppage of the drum 1 in response to detection of unsatisfactory transfer of an article (e.g., in response to the absence of transfer of an article during a predetermined stage of rotation of the output element 92).

When the rate of delivery of filter rod sections or other rod-shaped articles 3 of the tobacco processing industry by the pneumatic conveyor 16 to the machine which is to process the articles (e.g., a filter tipping machine) exceeds the requirements of such machine, the electromagnet 82 receives from the machine an impulse which entails a movement of the pad 81 into the interior of the magazine 13 to engage the end faces 86 of the adjacent articles 3 of the supply 7 so that the other end portions of the thus engaged articles are urged against the wall 9. This establishes a bridge of blocked articles 3 across the outlet of the magazine 7 so that the delivery of articles into the flutes 2 of the drum 1 is interrupted. The pad 81 is sufficiently elastic and its stroke toward the end faces 86 of the adjacent articles 3 of the supply 7 in the magazine 13 is sufficiently short to ensure that the engaged articles are not destroyed or damaged as a result of energization of the electromagnet 82. The drum 1 then removes from the magazine 13 those articles 3 which are located beneath the aforementioned bridge of articles held by the pad 81; thereafter, the drum is automatically brought to a halt because the detector 99 fails to transmit a signal which is indicative of satisfactory transfer of an article into the pneumatic conveyor 16. It is necessary to deenergize the electromagnet 82 in order to restart the motor 91. Deenergization of the electromagnet 82 results in return movement of the pad 81 to the inoperative position of FIG. 1 so that the articles 3 which constituted the bridge across the outlet of the magazine 13 are free to descend toward and onto the adjacent portion of the drum 1.

An important advantage of the improved apparatus is that it can establish optimum circumstances for the transfer of successive articles 3 into the pneumatic conveyor 16 because the drum 1 is at least decelerated or even arrested at the time of actual expulsion of articles from the respective flutes. On the other hand, abrupt acceleration of the drum upon completion of the transfer of an article ensures that the apparatus can transfer large numbers of articles per unit of time. The likelihood of jamming or destruction of articles 3 during transfer into the conduit 14 and pneumatic conveyor 16 is less pronounced than in heretofore known apparatus because the speed of the drum during actual transfer is low. In addition, the detector 99 ensures rapid detection of unsatisfactory transfer of an article so that the attendants can immediately proceed with inspection of the station B in order to ascertain and eliminate the cause of malfunction. Still further, the drum is decelerated to less than maximum speed when a signal from the detector 99 initiates a complete stoppage of the drum if the drum is not at a standstill during the intervals of actual transfer of successive discrete articles into the pneumatic conveyor. Thus, a signal from the detector 99 need not entail a deceleration of the drum 1 from maximum speed to zero sppeed but merely a reduction of the relatively low speed to zero speed or prevention of renewed acceleration from zero speed.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art and, therefore, such adaptations should and are intended to be comprehended within the meaning and range of equivalence of the appended claims,

What is claimed is:

1. Apparatus for transporting rod-shaped articles of the tobacco processing industry from a supply of articles in a magazine having an outlet into an inlet of a pneumatic conveyor, comprising a rotary conveyor having a series of receptacles for rod-shaped articles and being disposed between said outlet and said inlet; means for discontinuously driving said rotary conveyor to a plurality of different angular positions in each of which one of said series of receptacles is aligned with said inlet and at least one other receptacle registers with and can receive articles from said outlet, comprising a variable-speed prime mover and means for varying the speed of said prime mover in accordance with a predetermined program; and means for pneumatically transferring articles from said one receptacle into the inlet of the pneumatic conveyor.

2. The apparatus of claim 1, wherein said receptacles form a circular array of equidistant receptacles and said driving means comprises means for indexing the rotary conveyor to align successive equidistant receptacles of said array with said inlet, said prime mover and said means for varying the speed of said prime mover forming part of said indexing means.

3. The apparatus of claim 1, wherein said means for varying the speed of said prime mover comprises means for alternately rotating said rotary conveyor at a higher first speed to move successive receptacles of said series toward alignment with said inlet and at a lower second, speed during intervals between movements or said rotary conveyor at said first speed.

4. The apparatus of claim 1, further comprising detector means including means for monitoring the transfer of articles from said one receptacle into said inlet and for arresting said driving means in response to detection of unsatisfactory transfer of articles into said inlet.

5. The apparatus of claim 4, wherein said detector means forms part of said speed varying means.

6. The apparatus of claim 3, wherein said second speed is at least close to zero speed.

7. The apparatus of claim 1, wherein said prime mover includes an electric motor.

8. The apparatus of claim 1, wherein said means for varying the speed of said prime mover comprises a source of first signals denoting a desired first speed of the prime mover, means for generating second signals denoting the actual speed of the prime mover, means for generating third signals denoting the difference between the first and second signals, an energy source for the prime mover, and adjustable amplifier means interposed between said energy source and said prime mover to regulate the transmission of energy to said prime mover as a function of said third signals.

9. The apparatus of claim 8, wherein said source of first signals includes means for transmitting incremental first signals.

10. The apparatus of claim 8, wherein said means for generating second signals includes means for transmitting incremental second signals.

11. The apparatus of claim 8, wherein said source of first signals inludes means for transmitting coded digital signals.

12. The apparatus of claim 8, wherein said means for generating second signals includes means for generating coded digital signals.

13. The apparatus of claim 1, wherein said magazine contains a supply of filter rod sections.

14. The apparatus of claim 1, wherein said rotary conveyor comprises a drum rotatable about a predetermined axis and having a peripheral surface, said receptacles including flutes provided in said peripheral surface and being parallel to said axis.

* * * * *